US006508606B1

(12) United States Patent
James, III et al.

(10) Patent No.: US 6,508,606 B1
(45) Date of Patent: Jan. 21, 2003

(54) CURB FORMING APPARATUS

(75) Inventors: W. Thomas James, III, Salem, OH (US); Randal L. Best, Poland, OH (US); James B. Rochette, Columbiana, OH (US)

(73) Assignee: Miller Spreader Company, Youngstown, OH (US)

( * ) Notice: Subject to any disclaimer, the term of this patent is extended or adjusted under 35 U.S.C. 154(b) by 151 days.

(21) Appl. No.: 09/663,809

(22) Filed: Sep. 15, 2000

(51) Int. Cl.[7] ..... B28B 3/02
(52) U.S. Cl. ..... 404/98; 404/105; 404/106
(58) Field of Search ..... 404/98, 105, 106

(56) References Cited

U.S. PATENT DOCUMENTS

| | | | | | |
|---|---|---|---|---|---|
| 2,707,422 | A | | 5/1955 | Canfield | |
| 2,818,790 | A | | 1/1958 | Canfield et al. | |
| 3,137,220 | A | | 6/1964 | Smith | |
| 3,363,523 | A | | 1/1968 | Brock et al. | |
| 3,554,291 | A | * | 1/1971 | Rogers et al. | 172/4.5 |
| 3,665,821 | A | * | 5/1972 | Walker | 404/113 |
| 3,749,504 | A | * | 7/1973 | Smith | 404/84.2 |
| 3,779,661 | A | | 12/1973 | Godbersen | |
| 3,779,662 | A | * | 12/1973 | Smith | 404/98 |
| 3,792,133 | A | | 2/1974 | Goughnour | |
| 3,915,584 | A | * | 10/1975 | Coho et al. | 404/98 |
| 3,920,349 | A | * | 11/1975 | Jennings et al. | 404/98 |
| 3,969,035 | A | * | 7/1976 | Silbernagel | 404/98 |
| 3,970,405 | A | * | 7/1976 | Swisher et al. | 404/105 |
| 4,218,789 | A | * | 8/1980 | Grassi | 5/201 |
| 4,298,293 | A | | 11/1981 | Baucom | |
| 4,384,806 | A | * | 5/1983 | Taylor, Jr. | 404/105 |
| 4,566,822 | A | * | 1/1986 | Miller | 404/100 |
| 4,566,823 | A | * | 1/1986 | May | 404/98 |
| 4,710,064 | A | * | 12/1987 | Stafford et al. | 405/288 |
| 4,789,266 | A | * | 12/1988 | Clarke et al. | 404/104 |
| 4,822,210 | A | * | 4/1989 | Oury et al. | 404/106 |
| 4,984,932 | A | | 1/1991 | Leone | |
| 5,018,955 | A | | 5/1991 | Parrish et al. | |
| 5,161,268 | A | * | 11/1992 | Harrow | 403/254 |
| 5,407,171 | A | * | 4/1995 | Gonzalez | 248/670 |
| 5,527,129 | A | * | 6/1996 | McKinnon | 404/98 |
| 6,022,171 | A | * | 2/2000 | Munoz | 404/120 |
| 6,033,105 | A | * | 3/2000 | Barker et al. | 222/241 |
| 6,089,787 | A | * | 7/2000 | Allen et al. | 404/118 |

OTHER PUBLICATIONS

Kubota K008 Excavator, for www.kubota.com/prL29.cfm and www.kubota.com/kx2008features.cfm, 5 pages, Jul. 2000.*

Augers Unlimited, from http://www.augersunlimited.com/ ®2000, including pages "Augers", "Flighting", and "Custom"; 5 pages.*

* cited by examiner

*Primary Examiner*—Heather Shackelford
*Assistant Examiner*—Katherine Mitchell
(74) *Attorney, Agent, or Firm*—Harpman & Harpman

(57) ABSTRACT

An apparatus for continuously shaping and extruding a longitudinally extending curb of moldable material. The device provides a self-contained and self-powered platform for modular curb forming inserts of multiple disciplines including auger extrusion and vibratory slip form. Moldable material is supplied to a feed hopper for the modular auger/slip form inserts that creates and dispenses a shaped curb bed. Leveling sensors and guides compensate for irregular surface gradients maintaining the orientation of the formed curb shape.

20 Claims, 17 Drawing Sheets

CURB FORMING APPARATUS

BACKGROUND OF THE INVENTION

1. Technical Field

This device relates to curb forming machines that continuously slip form or extrude a pre-determined curb shape from moldable material such as concrete and the like.

2. Description of Prior Art

Prior art devices of this type typically have powered compression and extrusion augers or slip forms that travel along forming a continuous curb configuration of molded concrete material, see for example U.S. Pat. Nos. 2,707,422, 2,818,790, 3,137,220, 3,363,523, 3,779,661, 3,792,133, 4,298,293, 4,984,932 and 5,018,955.

In U.S. Pat. No. 2,707,422 a curb laying machine is disclosed having a fixed power auger extruder that propels the machine by pushing itself against the curb form as it is extruded.

U.S. Pat. No. 2,818,790 is directed to a curb and gutter-laying machine having multiple augers to extrude curb form for both a horizontal and vertical integral curb shapes are required.

U.S. Pat. No. 3,137,220 claims a feeding means for curb laying machines wherein curb shapes are achieved by the use of both fixed feed and auxiliary augers.

U.S. Pat. No. 3,363,523 described a pavement forming apparatus that forms paving material into curbs by using an external vibrating mold plate that compacts the asphalt material and moves the apparatus along.

Referring to U.S. Pat. No. 3,779,661 a machine and method are disclosed for preparing a sub-surface and fixed slip forming a curb thereon. This device has a grinding trimming portion and a slip form curb portion.

U.S. Pat. No. 3,792,133 discloses a machine for slip forming a concrete wall structure of asymmetrical transverse cross-section required in highway barrier walls. A large fixed mobile slip form is supplied material by a screw auger which extrudes the wall configuration.

U.S. Pat. No. 4,298,293 is directed to a curb forming apparatus for traveling along a pavement surface laying a curb on still wet pavement. This device has a slip fixed form and a supply chute utilizing a skid plate to slide along the surface.

In U.S. Pat. No. 4,984,932 a continuous concrete curb forming apparatus is shown having a fixed mold that can be raised and lowered as the curb is being laid so that a temporary height change can be achieved. This allows for the curb to be tapered downwardly as it nears an access area such as a driveway or the like.

A decorative curbing machine is disclosed in U.S. Pat. No. 5,018,955 wherein a fixed auger feeds a curb mold while being able to negotiate short radius curbing paths.

SUMMARY OF THE INVENTION

The present invention is directed to a self-powered modular curb forming apparatus that continuously forms and extrudes a curb configuration from concrete material. The apparatus provides a self-contained mobile platform in which different curb forming modules can be easily interchanged. This allows for a variety of curb forming configurations to be used in one machine. A number of curb forming techniques including power screw auger extrusion and vibratory slip forming can all be used in a single adjustable platform depending on the conditions and requirements as needed.

DESCRIPTION OF THE PREFERRED EMBODIMENT

Figure 1:
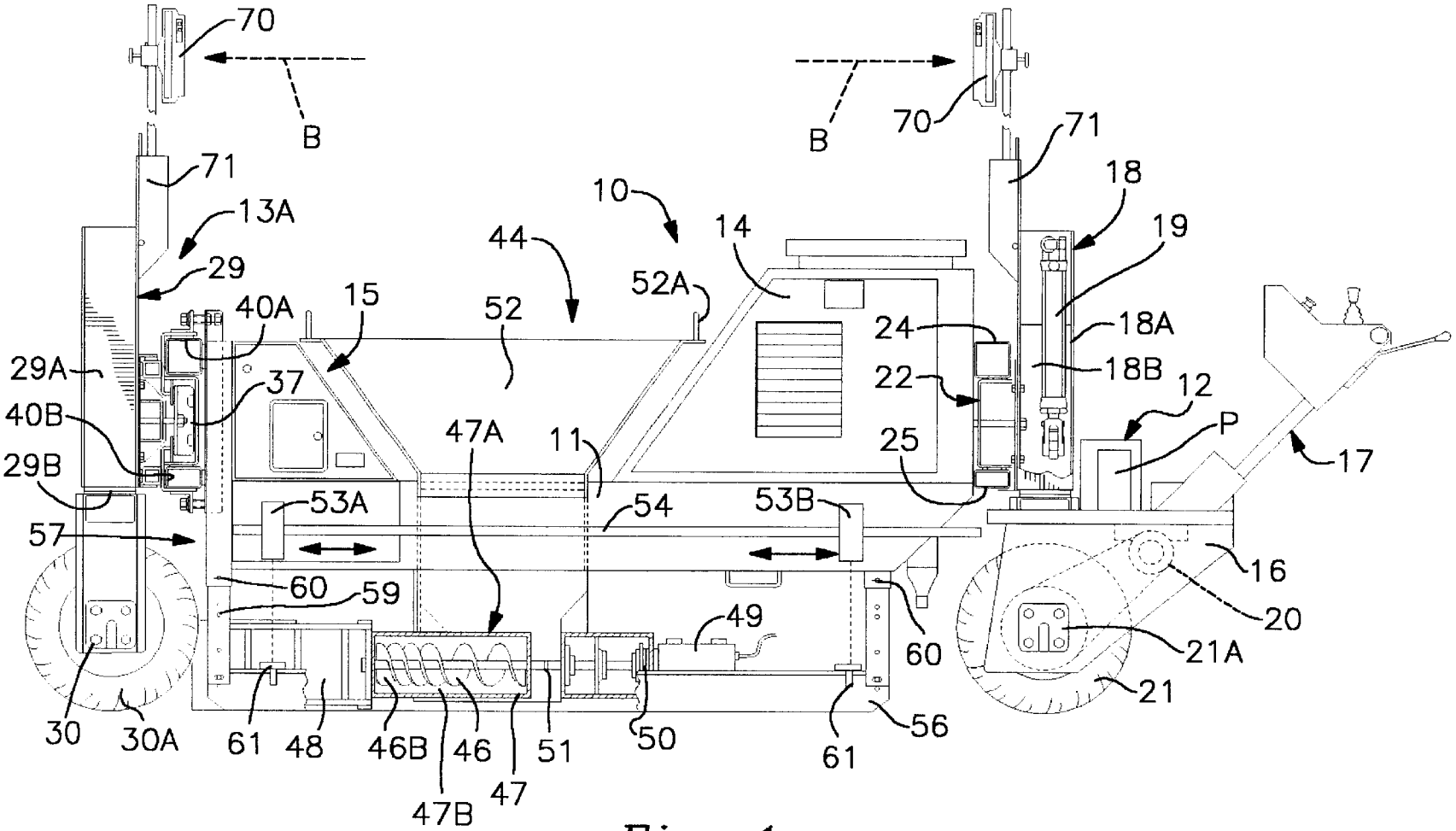
FIG. 1 is a side elevational view of the curb forming apparatus of the invention.
Figure 2:
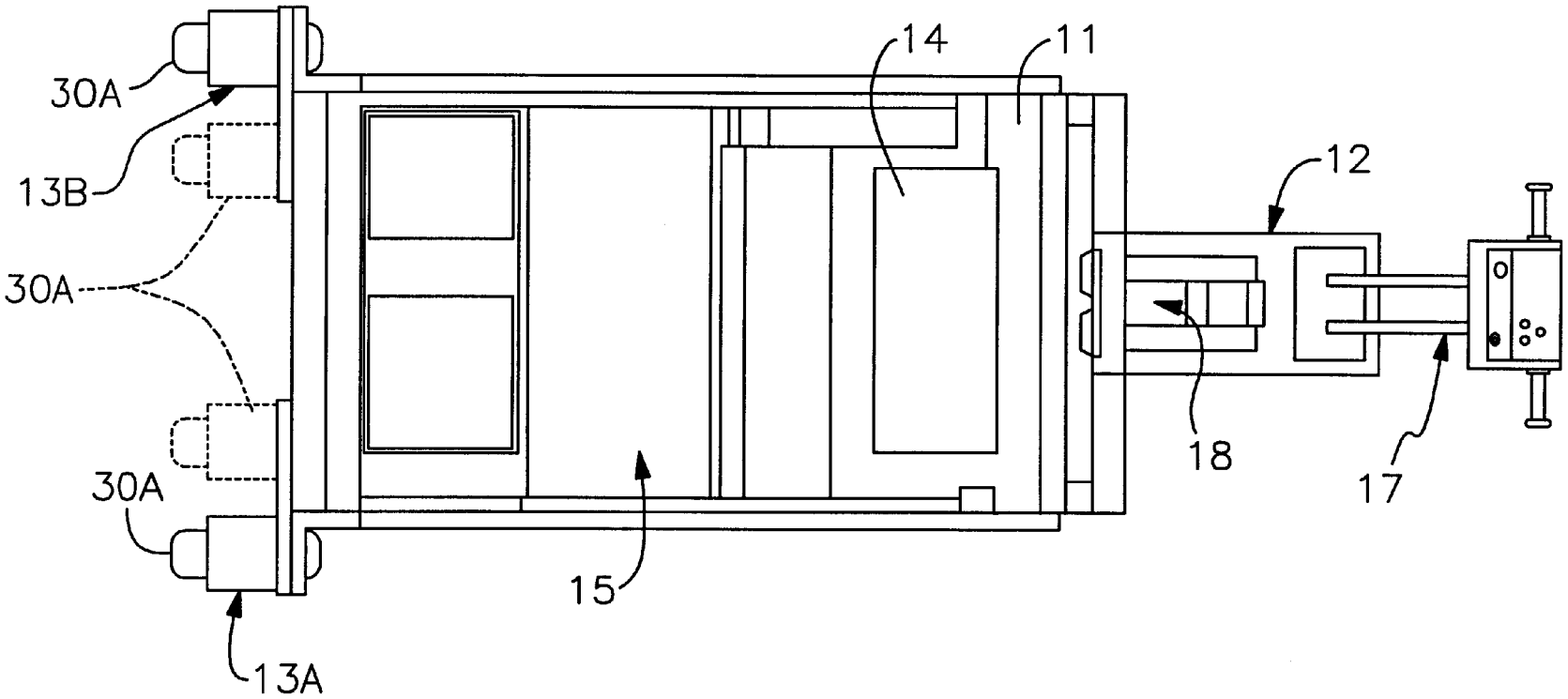
FIG. 2 is a top plan schematic view of the curb forming apparatus of the invention.

Referring to FIGS. 1 and 2 of the drawings, a curb forming apparatus 10 can be seen comprising a main support frame 11 with a front power drive wheel and steering assembly 12 and a pair of movable rear wheel assemblies 13A and 13B. The main support frame 11 has an engine compartment 14 near the front power drive wheel and steering assembly 12 and a modular insert receiving opening at 15 midway between the respective front power drive wheel steering assembly 12 and rear wheel assemblies 13A and 13B.

Referring now to FIGS. 1, 4, 5, and 6 of the drawings, the front power drive wheel and steering assembly 12 can be seen having a wheel mounting frame 16, a steering handle extension and control input assembly 17 extending therefrom.

Figure 7:
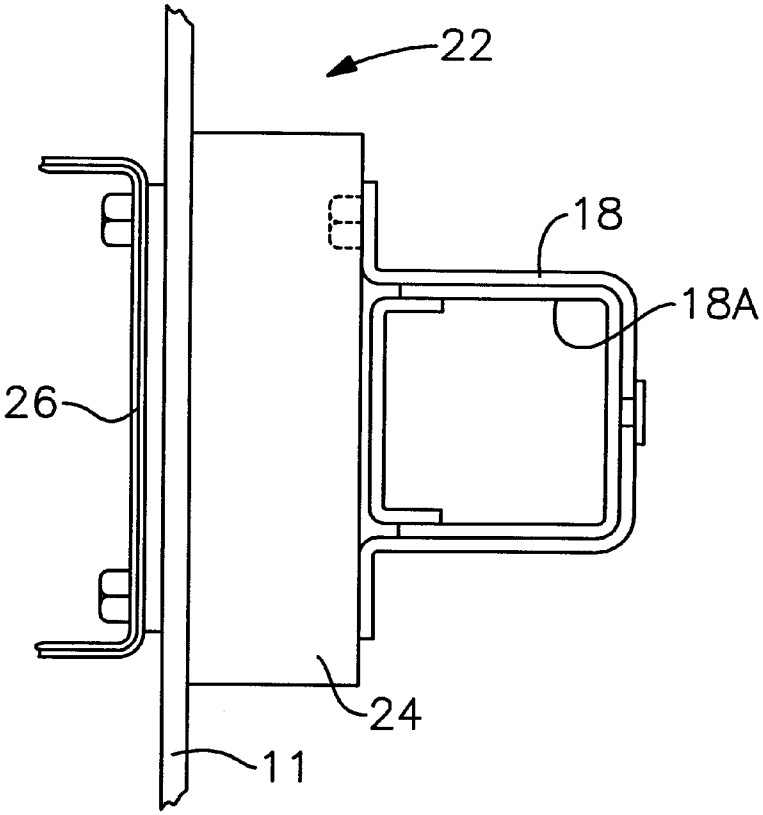
FIG. 7 is an enlarged partial cross-sectional top plan view of the assembly shown in FIG. 6.
Figure 6:
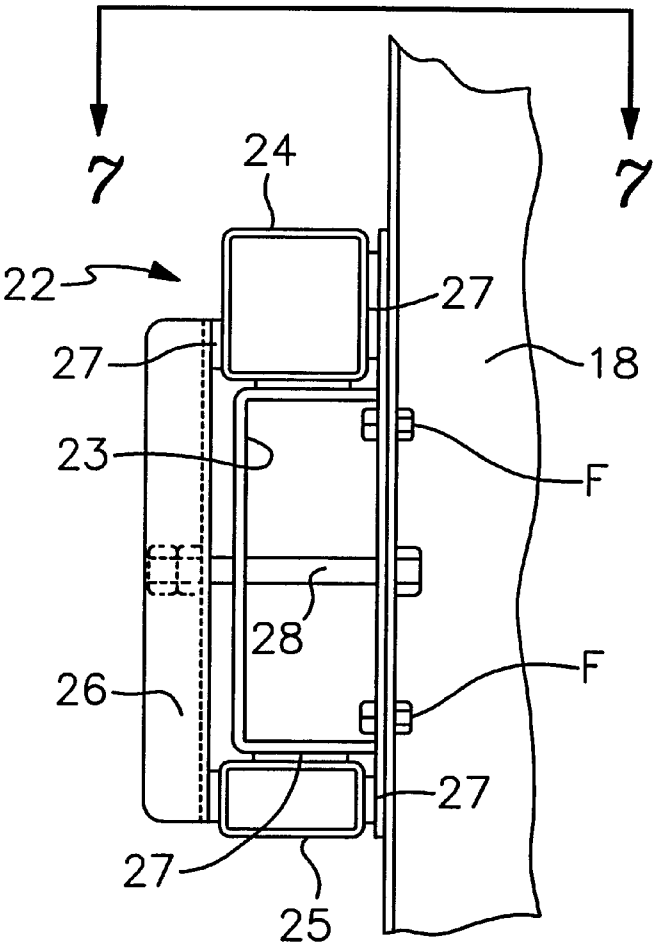
FIG. 6 is an enlarged partial sectional view of the front wheel support assembly interconnection to the curb forming apparatus.

A telescopically extensible wheel height adjustment and support column 18 extends vertically from the wheel-mounting frame 16 having an outer support casing 18A and an inner extensible wheel support member 18B. A hydraulic piston cylinder assembly 19 is secured between the respective support casing 18A and the inner extensible wheel support member 18D. An hydraulic drive motor 20 shown in dotted lines is interconnected to drive a pair of front drive wheels 21, rotatably positioned on the wheel support 21A, will be well understood by those skilled in the art. The drive wheel and steering assembly 12 is in turn movably secured to the main support frame 11 by a horizontally adjustable front slider assembly 22, best seen in FIGS. 4, 6 and 7 of the drawings. The slider assembly 22 is secured to the telescopically extensible support tubular column 18 by a guide bracket 23 with fasteners F. The guide bracket 23 is slideably disposed between a pair of parallel longitudinally spaced tubular tracks 24 and 25 and secured to the main support frame 11 to allow for horizontal movement of the steering assembly as indicated by arrows in FIG. 4. A locking clamp 26 slidably engages the respective tracks 24 and 25 from within the main support frame 11 so as to selectively lock the drive wheel and steering essembly 12 to the frame 11. A plurality of synthetic resin bearing surface inserts 27 are interengaged between the respective bearing surfaces of the tubular tracks 24 and 25, guide bracket 23 and slider clamp 26. Locking bolts 28 extend from and are secured to the slider clamp 26 through the guide bracket 23. It will be evident from the above description that by tightening the bolts 28 the drive wheel and steering assembly 12 can be selectively secured to the main support frame 11 after it has been repositioned thereon.

Figure 3:
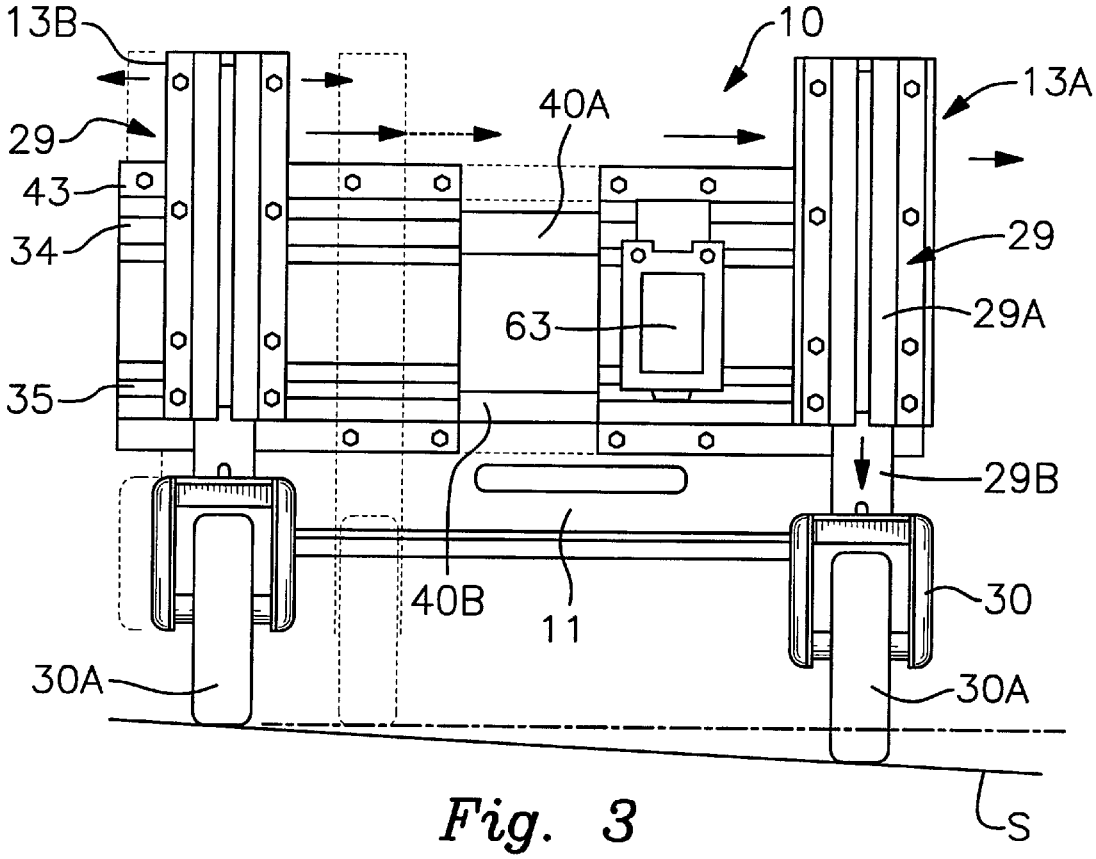
FIG. 3 is a rear elevational view of an adjustable rear wheel and slope compensation assemblies.
Figure 4:
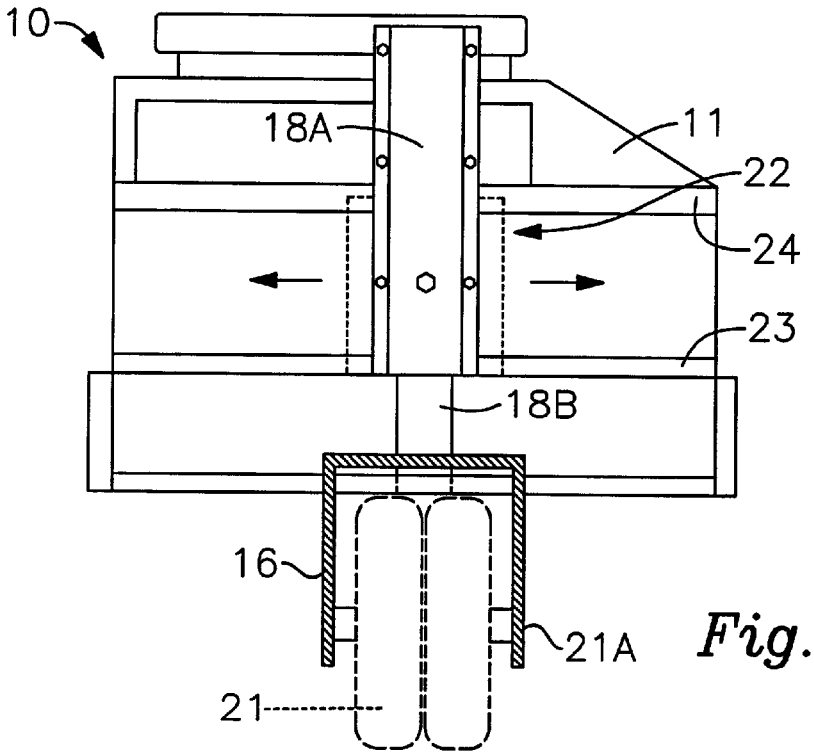
FIG. 4 is a partial front elevational view of the adjustable front wheel support assembly with portions broken away and in broken lines.
Figure 5:
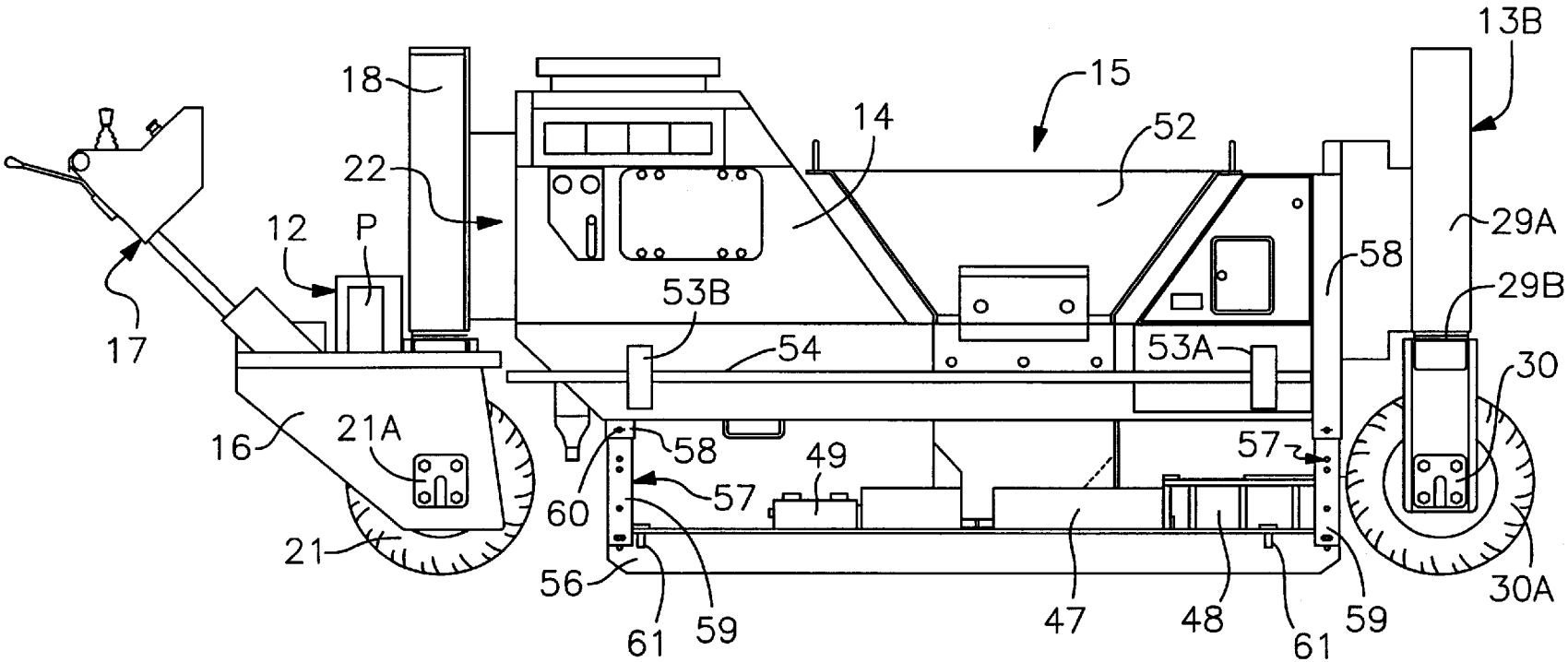
FIG. 5 is the reverse side elevational view of the curb forming apparatus generally illustrated in FIG. 1.
Figure 5A:
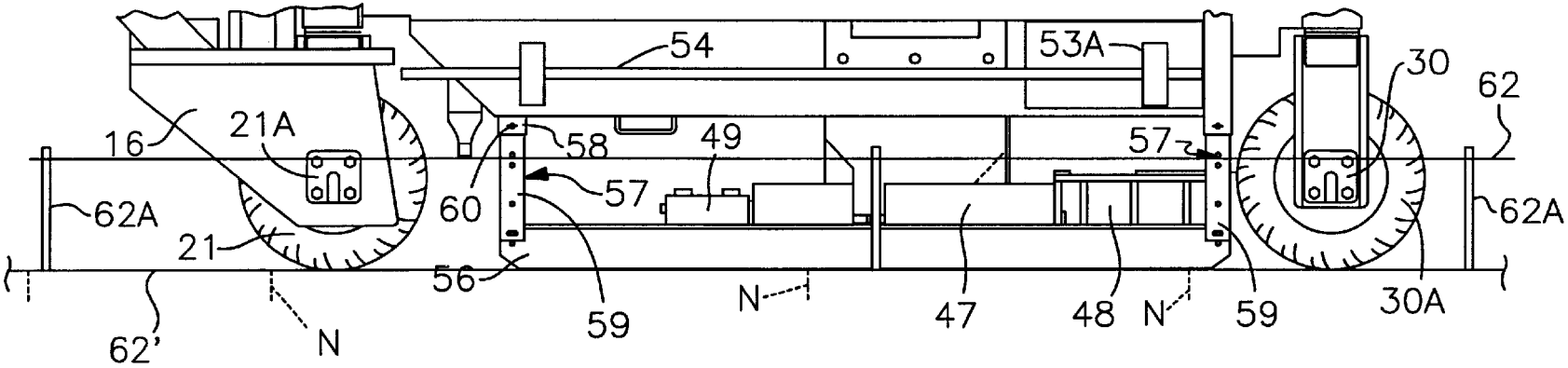
Figure 8:
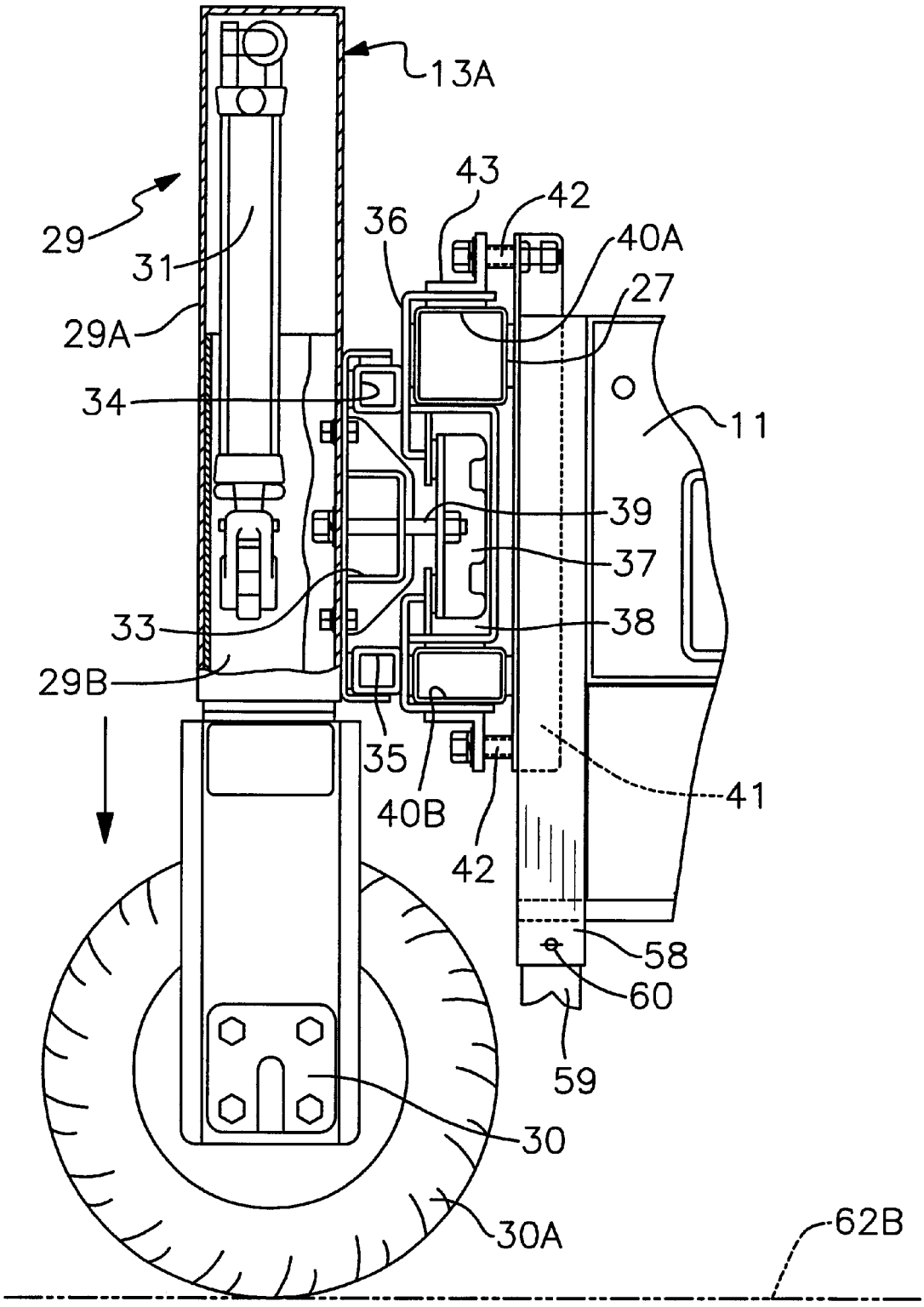
FIG. 8 is an enlarged cross-sectional view of the rear wheel adjustable support assembly.
Figure 9:
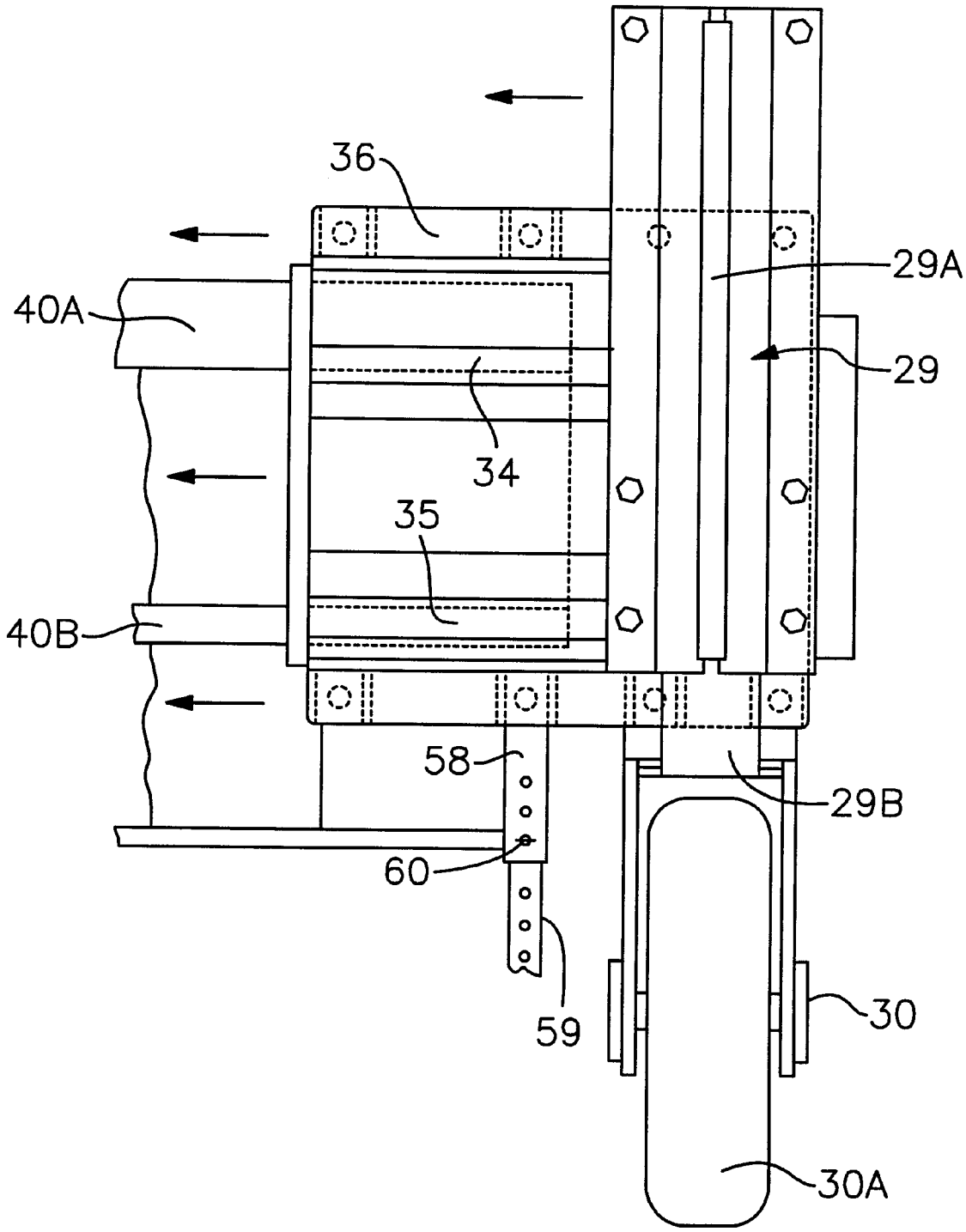
FIG. 9 is an enlarged rear elevational view of the adjustable rear wheel support assembly with portions broken away.

Referring now to FIGS. 3, 8, and 9 of the drawings, the rear wheel assemblies 13A and 13B can be seen, each having a telescopically adjustable support tube assembly 29 from which extends a wheel bearing support assembly 30 and attached wheel 30A. The adjustable support tube assembly 29 has an outer tubular member 29A and an inner support extensible portion 29B which are interengaged by hydraulic piston and cylinder assembly 31 so as to extend the inner support portion 29B and the wheel bearing support assembly 30 in relation thereto. The support tube assembly 29 has a secondary slider bracket 33 secured thereto which is slideably engaged on a pair of vertically spaced parallel tubular tracks 34 and 35 secured to a primary slider bracket 36. A secondary slider clamp 37 is positioned within a guide channel portion 38 of the primary slider bracket 36, best seen in FIG. 8 of the drawings. A secondary lock bolt 39 extends from the secondary slider clamp 37 through the secondary slider bracket 33 so as to selectively lock the support tube 29 against the tracks 34 and 35. The primary slider bracket 36 is selectively positioned on a pair of primary parallel vertically spaced tubular tracks 40A and 40B extending from the main support frame 11. A primary slider clamp 41 is movably positioned from within the main support frame 11 so as to be engaged against the tubular tracks 40A and 40B. Primary locking bolts 42 extend from the primary slider clamp 41 and through oppositely disposed flange fitting 43 on the primary slider bracket 36. It will thus be seen that each of the rear wheel assemblies 13A and 13B are horizontally adjustable on and beyond the main support frame 11 by the primary and secondary slider brackets on their respective tubular guide track pairs 33 and 34 and 40A and 40B as hereinbefore described and as best illustrated in FIGS. 3 and 8 of the drawings.

By repositioning the rear wheel assemblies 13A and 13B different curb forms can be used that are of a larger transverse cross-sectional end curb form as will be discussed in greater detail hereinafter.

Figure 10:
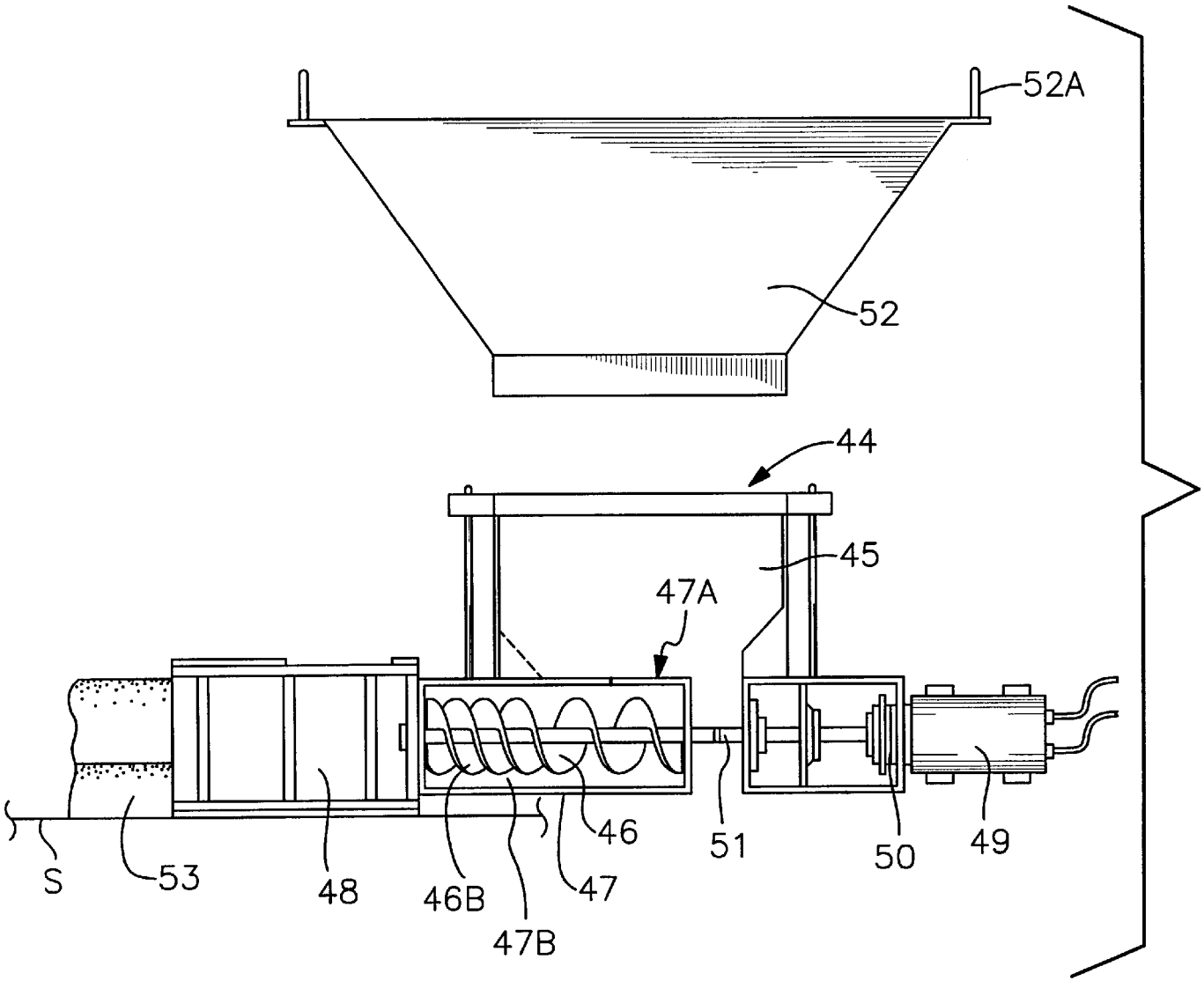
FIG. 10 is a side illustrative view of the auger extrusion module and hopper of the preferred embodiment.
Figure 11:
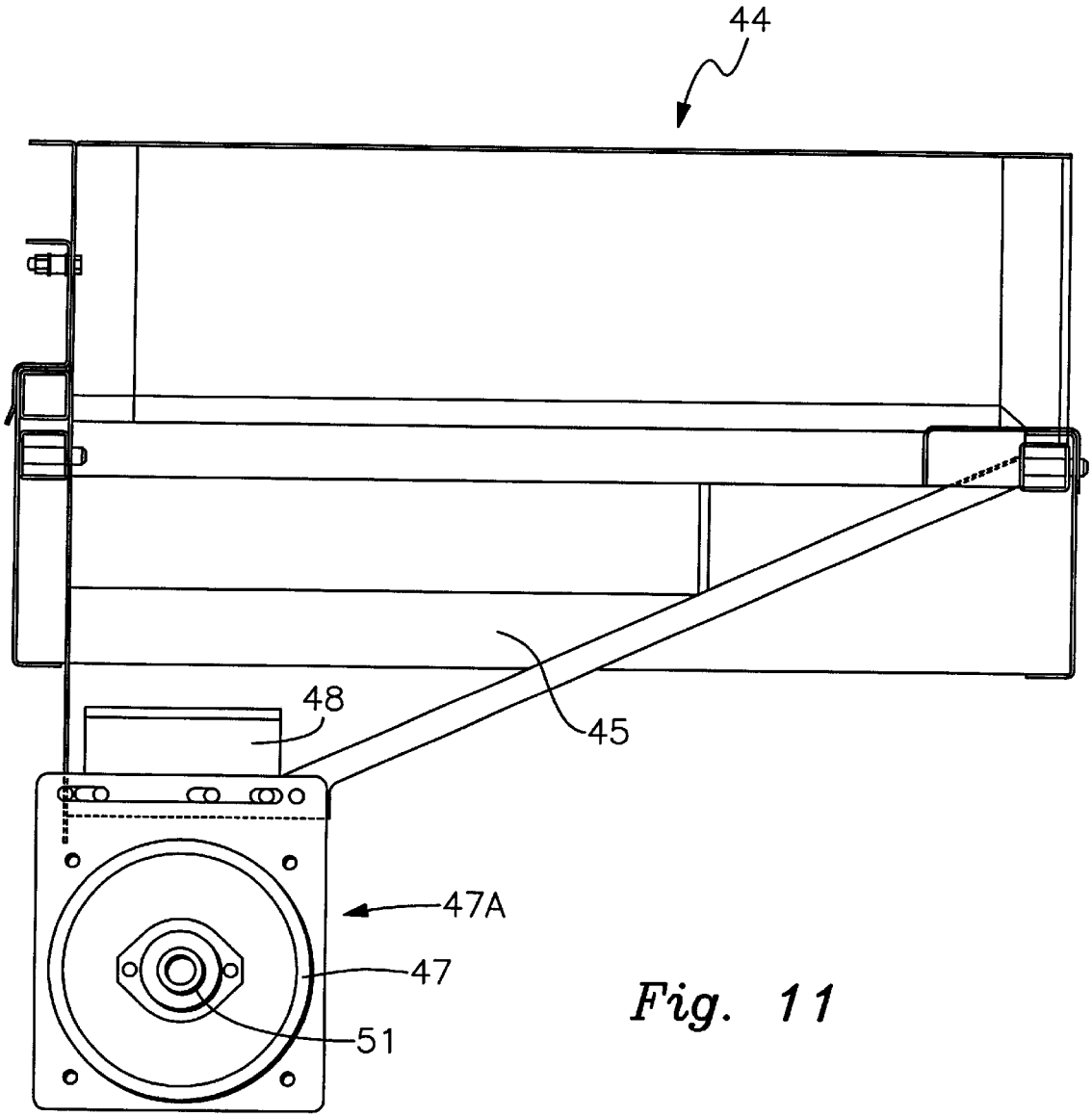
FIG. 11 is an end elevational view of the auger extrusion modular with portions shown in cross-section.

Referring now to FIGS. 1 and 2 of the drawings, the module insert opening 15 in the main support frame 11 can be seen in which a number of curb forming modules can be easily and rapidly installed. A curb forming auger extrusion module assembly 44 best seen in FIGS. 1 and 10 of the drawings has a material feed reservoir 45 that is registerable within the insert opening 15. An auger extrusion screw flight 46 is shown being rotatably positioned within a screw housing 47 having an open input area 47A that is in communication with the feed reservoir 45 and a closed compression area 47B which in turn is in communication with an extrusion curb form 48 in this example. The extrusion screw flight 46 within the closed compression area 47B has incrementally decreased flight spacing for increased flights at 46B which imparts material compression as it passes therethrough. A hydraulic motor 49 drives a flexible coupling 50 and interconnected ball bearing assemblies for an auger shaft 51 of the extrusion screw flight 46 as will be well understood by those skilled in the art. A supply hopper 52 for the curb forming auger assembly 44 is positioned to receive and direct concrete material (not shown) into the material feed reservoir 45 as hereinbefore described. Thus the extrusion curb form 48 will form a curb configuration 53 directly on the surface S as the curb forming apparatus 10 of the invention travels along the surface S.

Figure 12:
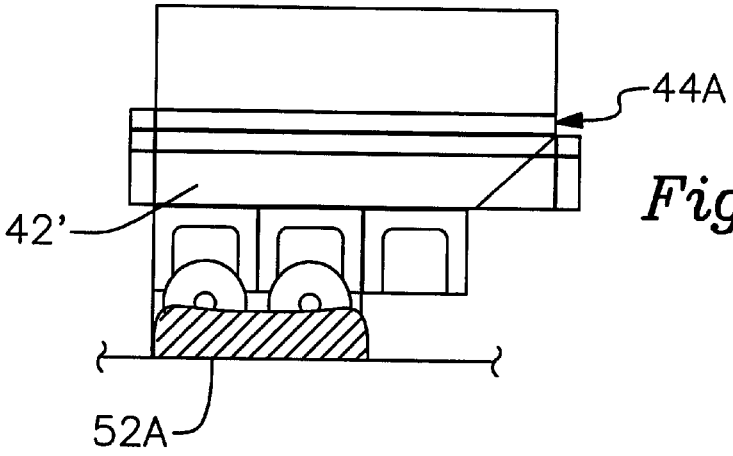
FIG. 12 is an end illustrative view of an alternate multiple auger extrusion module and resultant curb profile.
Figure 13:
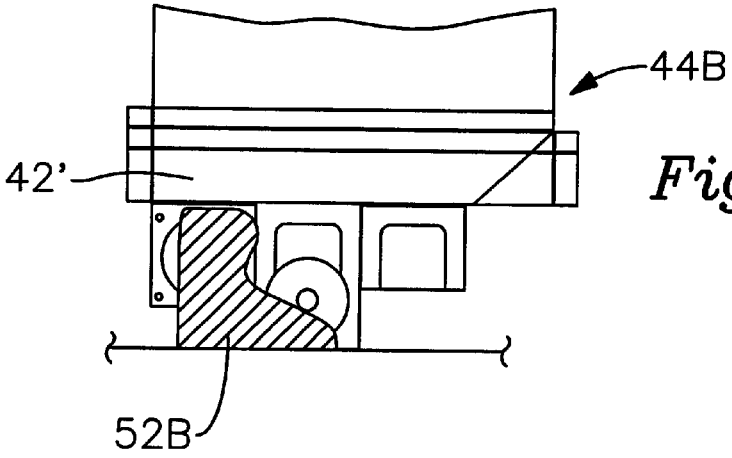
FIG. 13 is an end illustrative view of a second alternate multiple auger extrusion module and the resultant end curb profile.
Figure 14:
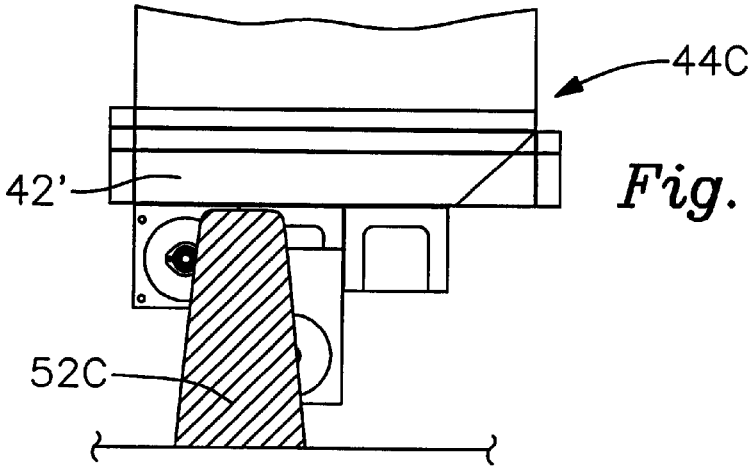
FIG. 14 is an end illustrative view of a third alternate multiple auger extrusion module and end curb profile.

Referring now to FIGS. 12,13 and 14, alternate curb forming auger drive module configurations 44A, 44B and 44C can be seen wherein multiple extrusion auger assemblies are mounted on a feed reservoir 42' with different curb extrusion forms 52A, 52B and 52C illustrated having various cross-sectional configurations. It will be seen that the multiple auger assemblies 44A, 44B and 44C illustrated can be mounted in relationships such as side by side illustrated in FIG. 12 or vertically staggered, illustrated in FIGS. 13 and 14 to achieve the required extrusion output of material of the auger assembly modules in relationship to the cross-sectional curb forms 52A, 52B and 52C to be formed.

Figure 15:
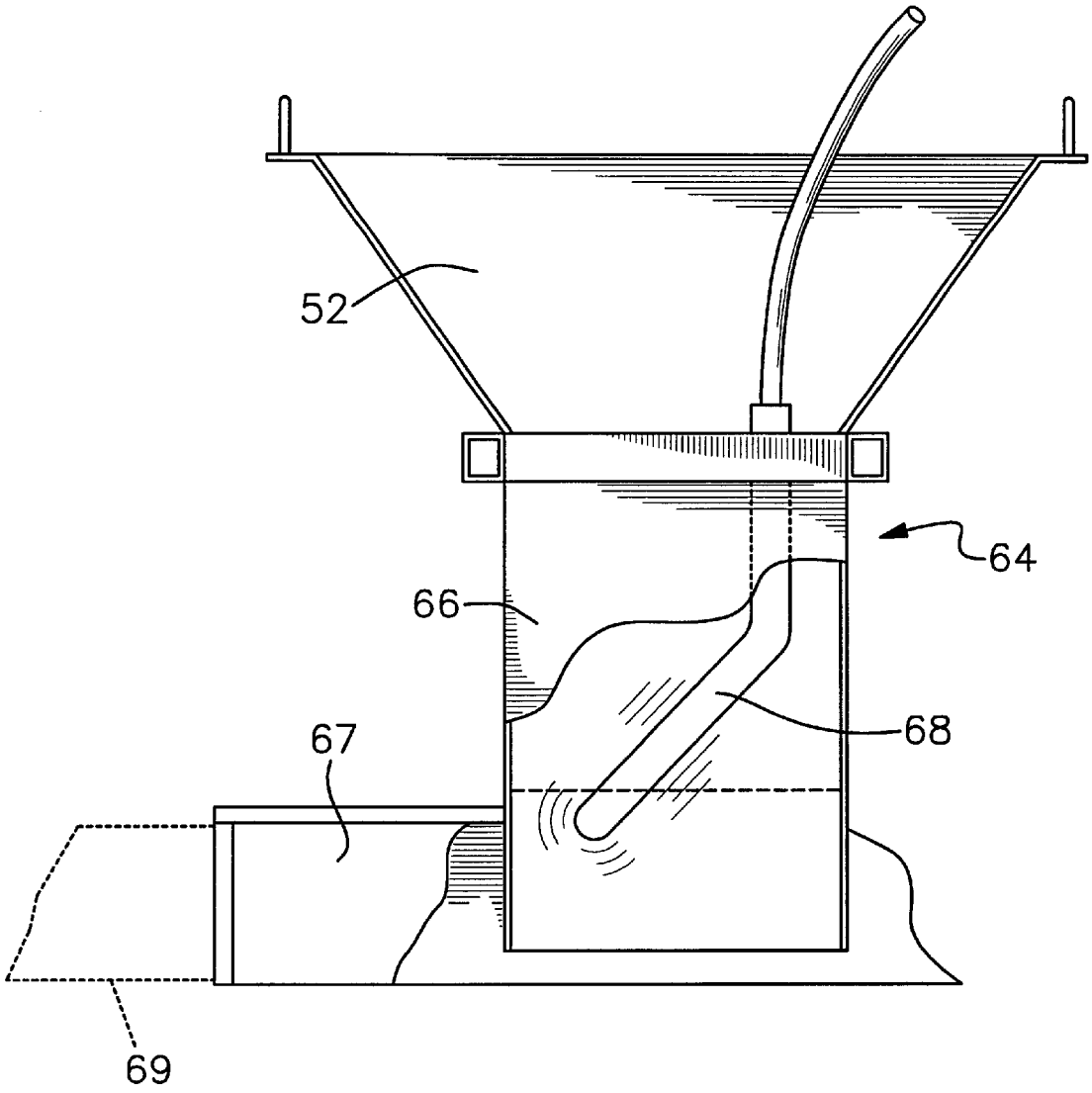
FIG. 15 is a side illustrative view of a slip form curb module for insertion into the apparatus of the invention.

Referring now to FIG. 15 of the drawings, an example of a slip form curb module 64 is illustrated having a supply hopper 52 with a feed bin 66 and a slip curb form 67. A vibrator device 68 is typically used within the feed bin 66 to facilitate the transfer of creatious material into the slip form curb module 67 and the formation of a finished curb 69 shown in broken lines.

The use of the slip form curb module 64 is dependent on a number of ancillary factors determined by the user and site conditions or as a matter of choice in certain applications.

During use to compensate for varying surface (S) conditions, the curb forming apparatus 10 of the invention has grade and slope activation sensors as seen in FIGS. 1–5 of the drawings so as to compensate for variations in the surface S as the apparatus of the invention transverses same.

Pairs of sonar sensors 53A and 53B are positioned on respective mounting bars 54 secured longitudinally to the either side of the support frame 11. In this example, the sonar sensors 53A and 53B are aligned to target respective pairs of surface engagement skids rails 56 that are secured to extensible jack assemblies 57 on each corner of the main support frame 11. Each of the jack assemblies 57 has a housing 58 with a tubular jack element 59 therein that can be extended and incrementally locked in position by pins 60 extending through aligned longitudinally spaced apertures within the respective housing and jack element 58 and 59 respectively. The skid rails 56 have sonar target reflectors 61 that are used by the respective sonars sensors 53A and 53B. As the skid rails 56 freely follow the surface S. The sonar sensors calculate the change in relative distance and activate the appropriate hydraulic cylinders assemblies 31 in the respective wheel assemblies to adjust and maintain the pre-programmed elevational requirements of the curb to be formed. Alternately, the sonar sensors 53A and 53B can use a string guideline 62' in place of the skid rails 56 as the guide target. The string guideline 62' would typically be secured to the grade surface by nails to accommodate certain situations that may preclude the use of the skid rails 56 as would be evaluated in the field, alternately a string line 62 can be used mounted between posts 62A. Additionally, a slope sensor 63 is mounted on the rear wheel assembly 13A and will adjust the height of the wheel assemblies 13A or 13B to the desired slope i.e. the transverse relationship of the surface S maintaining the pre-determined slope indicated by the apparatus as it travels along its designated path as best seen in FIG. 3 of the drawings. The skid rails 56 can also be used to support the apparatus of the invention for repositioning the respective wheel assemblies by extending and locking the jack stands and retracting the wheel assemblies as needed.

An alternate grade and slope sensing system can be used as illustrated in FIG. 1 of the drawings in which each of the adjustable wheel assemblies has a laser receiver 70 on a sensor-mounting fixture 71 extending from and secured to the respective wheel support tubes. The laser receivers 70 can determine the relative position of an impinging laser beam B from a surveyor's laser as best seen in FIG. 1 of the drawings.

Figure 16:
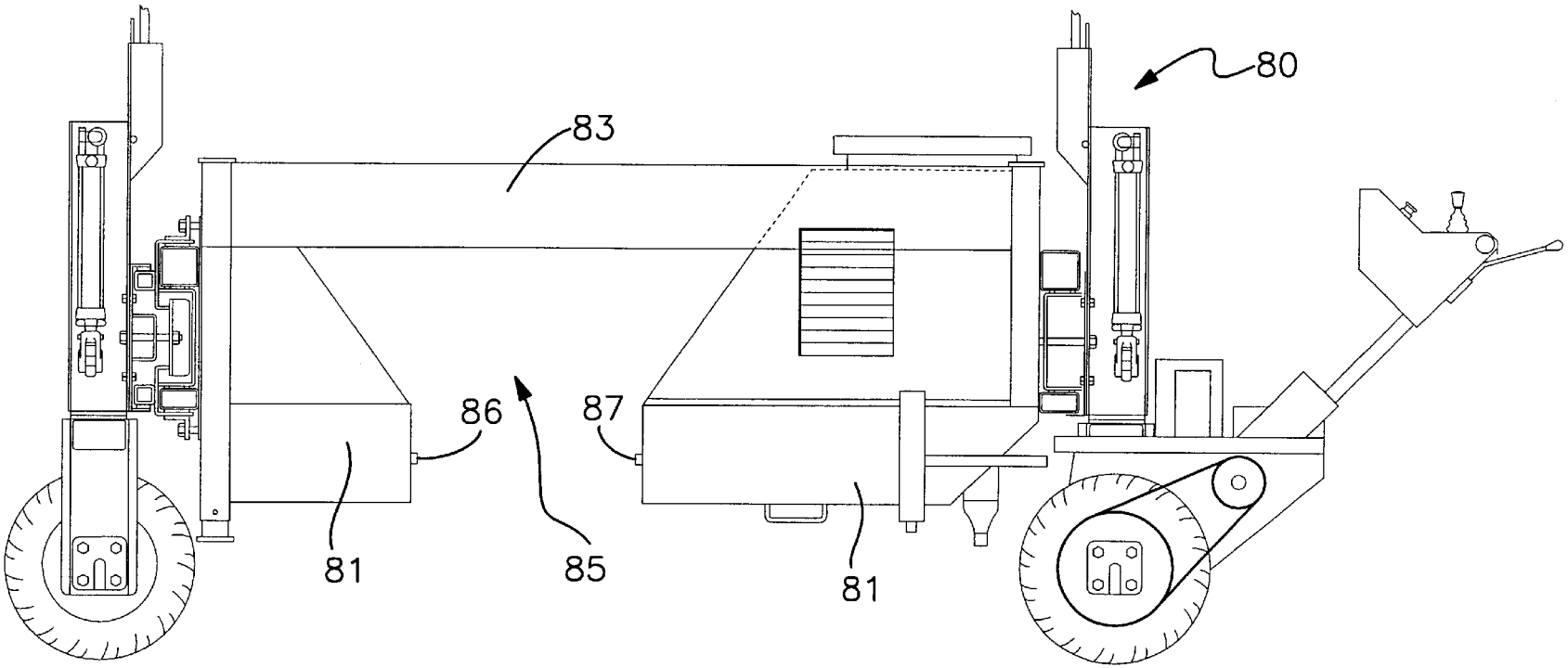
FIG. 16 is a side elevational view of an alternate form of the curb forming apparatus for use with a removable transfer feed module not shown.
Figure 17:
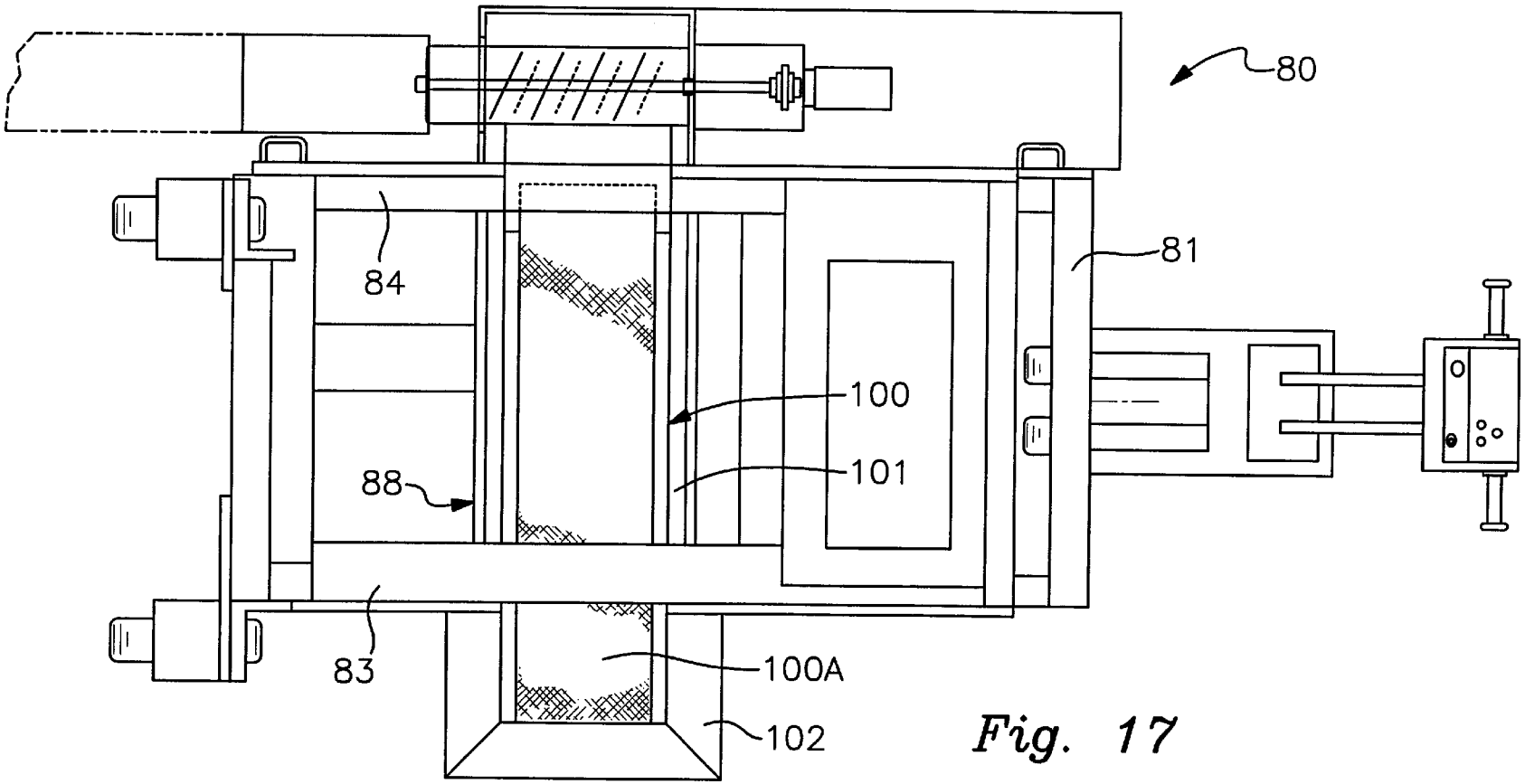
FIG. 17,is a top plan modified schematic view of the curb forming machine as seen in FIG. 16 with a removable transfer and feed module positioned within.
Figure 18:
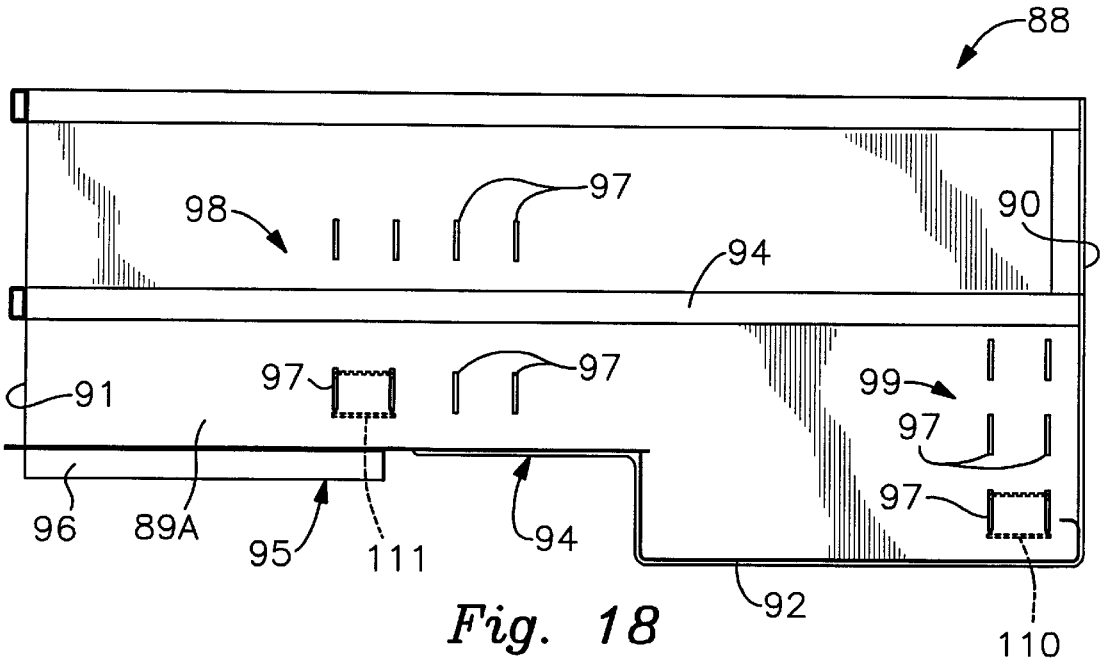
FIG. 18 is a side elevational view of a transfer and convey module frame for the curb forming apparatus as seen in FIGS. 16 and 17.
Figure 19:
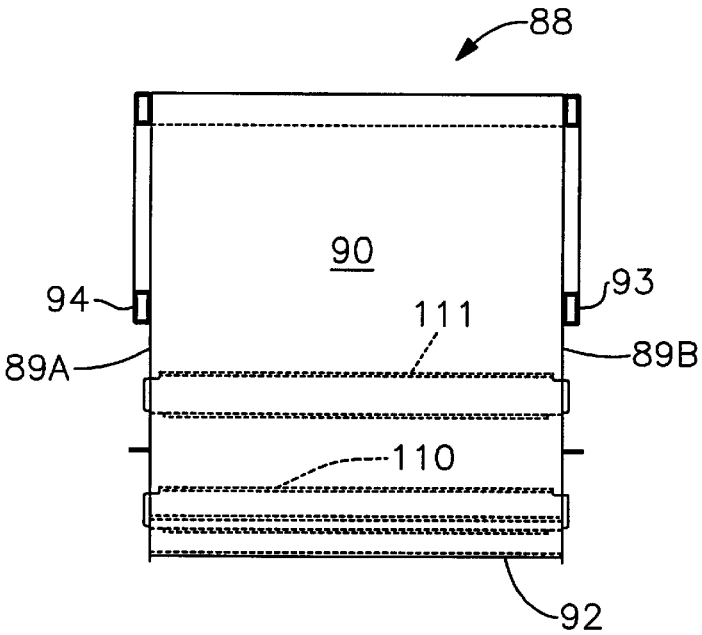
FIG. 19 is an end elevational view of the transfer and conveyor module frame as seen in FIG. 18.

Referring now to FIGS. 16 and 17 of the drawings, an alternate form of a curb forming apparatus 80 is illustrated, in which a modified main support frame 81 can be seen having a center section of the main support frame 81 and a pair of bridge frame elements 83 and 84 extending in spaced vertical relation thereacross maintaining the machine's integrity. The alternate curb forming apparatus 80 thus has defined a large access receiving area 85 having a pair of parallel oppositely disposed guide tracks 86 and 87 as seen in FIG. 16 of the drawings.

A material handling box 88 can be seen in FIGS. 17, 18, 19 and 20 having oppositely disposed side walls 89A and 89B, interconnecting end walls 90 and 91 ad integral bottom portion 92. The respective sidewalls 89A and 89B have a longitudinally extending guide channels 93 and 94 thereon. The guide channels 93 and 94 are registerable on respective guide tracks 86 and 87 so as to allow the material handling box 88 to be slidably positioned within the access receiving area from either side of the main support frame 81. The respective sidewalls 89A and 89B and end wall 91 define a bottom recess portion 94 therebetween inwardly from the respective end wall 91. The bottom 92 has a material of dispensing opening at 95 that extends transversely between the sidewalls 89A and 89B and inwardly of the respective end wall 91. An extension collar 96 extends about the opening 95 as will be best seen in figure 18 of the drawings.

Each of the sidewalls 89A and 89B have a plurality of spaced parallel pairs of elongated slots 97 in two positioning groups at 98 and 99 respectively.

Figure 20:
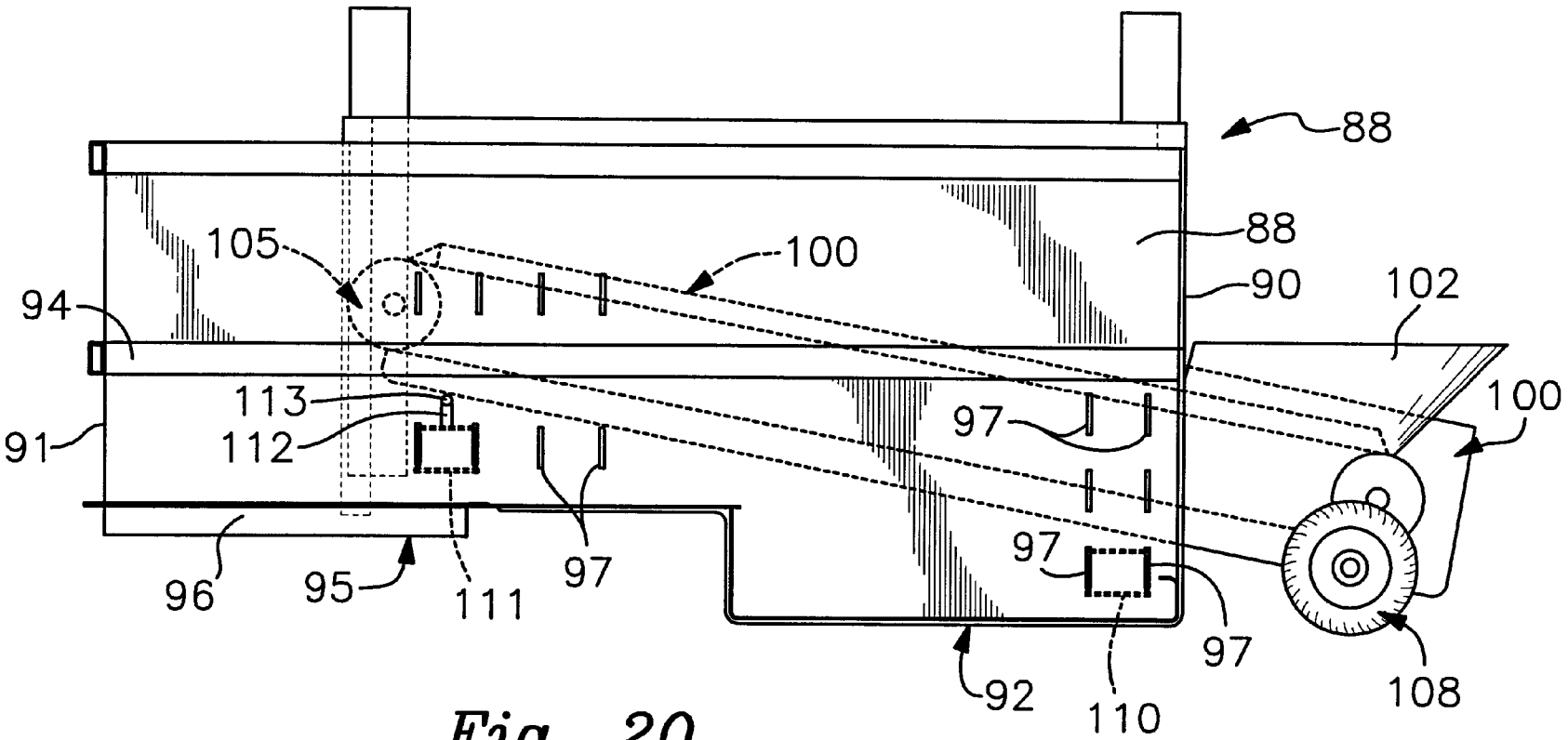
FIG. 20 is a side elevational view of the transportation and conveyor module frame with a conveyor assembly positioned within.
Figure 21:
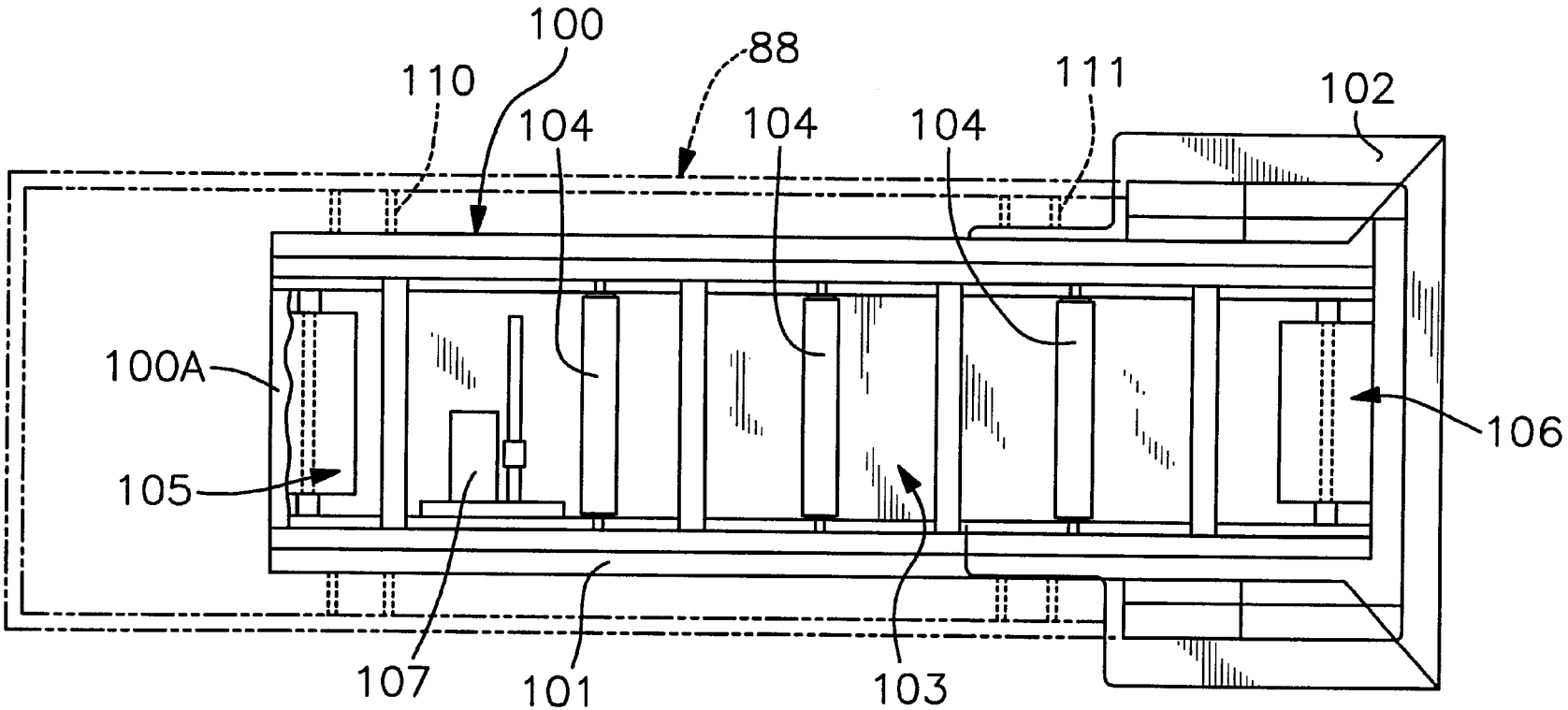
FIG. 21 is a top plan view of the transfer and conveying mounting frame as set forth in FIG. 20 of the drawings.

Referring now to FIGS. 17, 20 and 21 of the drawings, a mobile conveyor assembly 100 can be seen having a support frame 101 with an upstanding material receiving hopper 102 at one end thereof. A powered conveyor belt 103 is positioned within the support frame 101 having a plurality of belt engagement rollers 104 with an end return and drive roller assemblies 106 and 105 respectively. The drive roller 105 is driven by a hydraulic motor 107 as will be well understood by those skilled in the art.

Wheel assembly 108 extends from the hopper and of the conveyor assembly 100 and allows for same to be removed and transported as an independent unit. The conveyor belt assembly 100 is adjustably positioned within the material handling box 88 by a pair of independently positioned cross-support channels 110 and 111 that are registerable within respective oppositely disposed pairs of slots 97, best seen in FIG. 20 and in broken lines in FIG. 21. It will be evident that by repositioning the cross support channels 110 and 111 that different elevational positions of the conveyor assembly 100 can be achieved within the material handling box 88.

A mounting pin 112 and swivel fitting 113 in broken lines in FIG. 20 extends from the cross support channel 111 and allows a support integration with a portion of the conveyor assembly 100 so as to be selectively positioned as hereinbefore described.

It will be evident that the conveyor assembly 100 once positioned within the material handling box 88 which has been inserted within the access receiving area 85 that the hopper 102 of the belt assembly 100 will extend out beyond the curb forming apparatus 80 aligned for ease of access on either side of the device.

Additionally, it will be evident that the receiving hopper 102 of the belt assembly 100 is substantially lower relative to the open top portion of the material receiving box 88 and thus is easier to access during use from a materials supply mixing truck (not shown) and heretofore possible in the primary form of the invention. The alternate curb forming apparatus 80 of the invention will allow curb extrusion or slip forming beyond the frame "footprint" as illustrated in broken lines in FIG. 17 of the drawings.

Referring back to FIG. 1 of the drawings, it will be seen that the supply hopper 52 is removably secured from the main support frame 11 by mounting brackets 52A and is independent of the respective insert curb modules as noted above.

The steering handle extension and control input assembly 17 extending from the drive wheel assembly 12 has controls for the apparatus 10 of the invention in which the drive wheel assembly 12 can be pivoted so as to steer the apparatus 10 along its desired course and control its effective speed relative to the output of the curb forming modules positioned within.

In operation, an internal combustion engine, within the engine compartment 14 drives hydraulic pumps (not shown) therein which supply hydraulic fluid under pressure to the respective adjustable wheel assemblies, curb forming module inserts and hydraulic motor 20 of the steering and wheel assembly 12 as will be well understood by those skilled in the art.

From the foregoing, it will be appreciated that the present curb forming apparatus of the invention enables the production of a curb along a road bed surface S which can utilize a number of modular curb forming inserts of either the power auger extension or slip form type depending on the application desired along with precise control of grade end slope of the apparatus and the placement of the curb on said surface S during its operation. It will be apparent to those skilled in the art that various changes and modifications may be made therein without departing from the spirit of the invention.

We claim:

1. A curb forming apparatus comprising, a main support frame having multiple independent horizontally and vertically adjustable front and rear wheel assemblies, drive wheel and steering means on said front wheel assembly, primary and secondary horizontally adjustable slider bracket assemblies on said respective rear wheel assemblies, said primary slider bracket assembly comprising a pair of guide tracks on said support frame and said secondary slider bracket assembly comprises a pair of guide tracks on said primary slider bracket assembly, said slider bracket assemblies extending transversely from a first position within the transverse dimension of said main support frame to a second position beyond said transverse dimension of said main support frame, said adjustable front wheel assembly has a wheel mounting frame, drive wheels rotatably positioned on said frame, a drive motor interconnected to said drive wheels, a horizontally adjustable front slider assembly selectively interconnecting said front wheel assembly in longitudinally spaced relation to said main support frame, said front wheel assembly movably positioned along said front slider assembly within the transverse dimension of said main support frame an insert receiving area within said main support frame between said respective front and rear wheel assemblies, a curb extrusion module removably positioned within said insert receiving area, a supply hopper removably secured within said main support frame, means for determining and maintaining grade and slope of said apparatus in relation to a roadway, said curb extrusion module having a curb form through which curbing material is dispensed, a power source within said main support frame interconnected to said adjustable wheel assemblies and said curb extrusion module, said steering means comprises a steering and control assembly on said wheel mounting frame.

2. The apparatus set forth in claim 1 wherein said adjustable wheel assemblies on said rear of said main support frame further comprise, a telescopically extensible wheel support column, a wheel rotatably positioned thereon, the secondary horizontally adjustable slider bracket assembly secured to said wheel support column, the primary horizontally adjustable slider bracket assembly extending from said main support frame and engageable with said secondary horizontally adjustable slider bracket assembly, bearing means on said respective secondary and primary horizontally adjustable slider bracket assemblies for interengagement therewith.

3. The apparatus set forth in claim 1 wherein said primary slider bracket assembly further comprises, a primary slider clamp in spaced relation to say primary slider bracket engageable against said guide tracks and a pair of flange fittings on said primary slider bracket.

4. The apparatus set forth in claim 1 wherein said secondary slider bracket assembly is secured to said wheel support columns, resilient bearing surfaces on said secondary slider bracket assembly engageable on said primary slider bracket having a pair of vertically spaced parallel tubular tracks, a secondary slider clamp positioned within a portion of said primary slider bracket on said tubular tracks, a locking bolt extending from said secondary slider clamp through said secondary slider bracket and support column.

5. The apparatus set forth in claim 1 wherein said steering and control assembly extends from said wheel mounting frame, a telescopically extensible front wheel support column engageable to said wheel mounting frame.

6. The apparatus set forth in claim 1 wherein said guide tracks on said front wheel slider assembly are tubular and secured transversely on said main support frame, a front guide bracket secured to said front wheel support column slideably disposed between said front tubular tracks, a retaining clamp slidably disposed within said main support frame on said tubular tracks, a pair of first locking bolts extending from said front wheel support column through said front guide bracket and registerably engaged on said retaining clamp.

7. The apparatus set forth in claim 1 wherein said curb extrusion module comprises, a material feed reservoir, an auger assembly extending from said material feed reservoir having a variable auger extrusion screw fight within a screw housing, said variable auger extrusion screw flight comprising an auger shaft, a screw flight on said shaft wherein said screw flight has an area of reduced pitch, a drive motor interconnected to said extrusion screw flight and a curb extrusion form in communication with said screw housing.

8. The apparatus set forth in claim 7 wherein said curb extrusion module further comprises, an adjustable material conveying means extending from said material feed reservoir.

9. The apparatus set forth in claim 8 wherein said material handling receptacle is removably positioned within said insert receiving area by guide track means.

10. The apparatus set forth in claim 8 wherein said conveying means comprises, an endless belt conveyor within a support frame, a material receiving hopper extending from one end of said endless belt conveyor, drive means in communication with said endless belt conveyor and means for repositioning said conveyor within a material handling receptacle.

11. The apparatus set forth in claim 10 wherein said material handling receptacle and endless belt conveyor extends beyond said main support frame and said multiple adjustable wheel assemblies.

12. The apparatus set forth in claim 10 wherein said means for repositioning said endless belt conveyor within said material handling receptacle comprises, a pair of support channels extending transversely within said material handling receptacle in vertically spaced horizontal relation to one another.

13. The apparatus set forth in claim 12 wherein one of said support channels has an adjustable interengaging arm and pin assembly for registration within a portion of said endless belt conveyor.

14. The apparatus set forth in claim 1 wherein said means for determining and maintaining the grade of the apparatus of the invention in relation to said roadway surface comprises, multiple sensor transmitter receivers adjustably positioned on said main support frame, and surface engagement sonar targets.

15. The apparatus set forth in claim 14 wherein said surface engagement sonar targets comprises, targets on respective support skids adjustably secured to multiple extensible jack stands deployable from and secured to said main support frame.

16. The apparatus set forth in claim 14 wherein said surface engagement sonar targets further comprises, a guideline secured to the surface of said roadway.

17. The apparatus set forth in claim 1 wherein said means for determining and maintaining the slope of the apparatus of the invention in relation to said roadway comprises, a slope transmitter on one of said rear wheel assemblies.

18. The apparatus set forth in claim 1 wherein said power source within said main support frame comprises, an internal combustion engine and hydraulic fluid pump interconnected to said respective wheel assemblies and said curb forming modules.

19. The apparatus set forth in claim 1 wherein said main support frame defines bridge elements that extend over said insert receiving area.

20. A curb forming apparatus comprising, a main support frame, multiple independent adjustable rear wheel assemblies on said support frame, a drive wheel and steering means on a front wheel assembly, an insert receiving area within said main support frame between said respective front and rear wheel assemblies, a curb extrusion module removably positioned within said insert receiving area, said curb extrusion module comprises a material handling receptacle and adjustable endless belt conveyor within a support frame, a material receiving hopper extending from one end of said endless belt conveyor, drive means in communication with said endless belt conveyor, a pair of support channels extending transversely within said material handling receptacle in vertical spaced horizontal relation to one another for positioning said endless belt conveyor within the material handling receptacle, one of said support channel has an adjustable inner engaging arm and pin assembly for registration with a portion of said endless belt conveyor, grade determining and maintaining sensor transmitter receivers adjustably positioned on said main support frame, sonar targets on adjustable ground engaging extensions of said main support frame.

* * * * *